United States Patent [19]

Payne et al.

[11] 4,212,266

[45] Jul. 15, 1980

[54] CATCHER AND RETURN DEVICE FOR OVERSPRAYED POWDER

[75] Inventors: Robert D. Payne, Countryside; Fred E. Buczkowski, Cicero; Wesley J. Szpitalak, Palos Park, all of Ill.

[73] Assignee: The Continental Group, Inc., New York, N.Y.

[21] Appl. No.: 972,158

[22] Filed: Dec. 21, 1978

[51] Int. Cl.[3] ..... B05B 5/08; B05C 7/02; B05C 19/00

[52] U.S. Cl. ..... 118/712; 118/308; 118/317; 118/622; 239/693

[58] Field of Search ..... 118/312, 308, 317, 9, 118/622, 653, 306, 712, 50; 427/28, 181; 51/411, 424, 425; 239/693

[56] References Cited

U.S. PATENT DOCUMENTS

| | | | |
|---|---|---|---|
| 847,269 | 3/1907 | Wise | 51/424 |
| 3,491,721 | 1/1970 | Gill et al. | 427/28 X |
| 3,882,818 | 5/1975 | Mowbray | 118/312 |
| 4,098,226 | 7/1978 | Furter | 118/317 X |

*Primary Examiner*—John P. McIntosh
*Attorney, Agent, or Firm*—Charles E. Brown

[57] ABSTRACT

A powder system for electrostatically applying a powder coating to a can body side seam area. The system incorporates a catcher which is positioned and is of a configuration to catch and return substantially all of the powder overspray and stray powder particles. A constant vacuum is maintained in the catcher by way of a vacuum flow transducer.

10 Claims, 5 Drawing Figures

CATCHER AND RETURN DEVICE FOR OVERSPRAYED POWDER

This invention relates in general to new and useful improvements in container construction, and more particularly to the application of an internal side seem coating in the form of an electrostatically charged and retained powder stripe.

In the formation of containers other than those which have tin coatings, in most uses it is necessary to provide an internal coating so as to prevent product contamination. For some time beverage can bodies have been formed by welding operations after which the side seam area has been coated by means of a powder stripe. It is now desirable to form food cans in a similar manner of tin-free steel with the side seams being either welded or soldered. However, different problems are encountered with respect to food cans than beverage cans. Most particularly, the difference is that a beverage can is provided with an initial interior coating which is supplemented by side seam striping and finally, after the can body has been completed, there is applied an additional inside top-coat which covers the initial coating and the side stripe.

During powder application of the inside stripe, overspray occurs which results in stripe material being deposited away from the seam area where it is not wanted and where it will not be cured by the heat generated during the formation of the side seam. This powder overspray later becomes a food contaminant. In the case of a beverage can, the side top-coat is cured in a bake oven with the result that the oversprayed stripe powder is also cured. This additional inside top-coat is not traditionally used for food cans and is economically undesirable. Accordingly, prior powder stripe application equipment usable in conjunction with beverage cans is not suitable for use in internal side striping food cans.

This invention particularly relates to the removal of powder overspray and is particularly directed to a catcher which is so constructed wherein it will receive both stray powder particles and the powder particles directed against the side seam in excess of what is required for the coating.

The catcher is mounted downstream of the applicator and is provided with a first powder passage which is directly aligned with the powder passage of the applicator and serves to receive such stray powder as may be blown through the applicator by additional air supply.

The catcher includes a catcher housing which is open at the top and the catcher is so positioned relative to the applicator that excess powder striking the side seam area of a can body and not bonding to the can body will be deflected down into the catcher housing for return.

Beneficially, the catcher is of a simple construction, light in weight and readily attachable to the applicator.

Another feature of the catcher is that although the return tube or line may have a length on the order of twenty feet, the required suction can be maintained both within the return tube and the catcher so as to maintain a continuous return flow of collected powder. Suitable vacuum means are coupled to the return tube and are preferably formed of a vacuum flow transducer.

The vacuum within the return line adjacent the catcher may be monitored by means of a simple water manometer.

It is apparent that the major powder load on the catcher and the return line is due to powder which passes entirely through the applicator without being deposited. This powder load is a function of applicator length; the longer the applicator the less powder there is to be caught and returned. In principle, a sufficiently long applicator would charge and deposit on the can body side seam area all of the delivered powder. However, the length of the applicator is constrained by the practical consideration of supporting the total applicator from one end, as well as other practical space considerations. The use of the catcher and the associated return enables the use of an applicator of a practical length.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
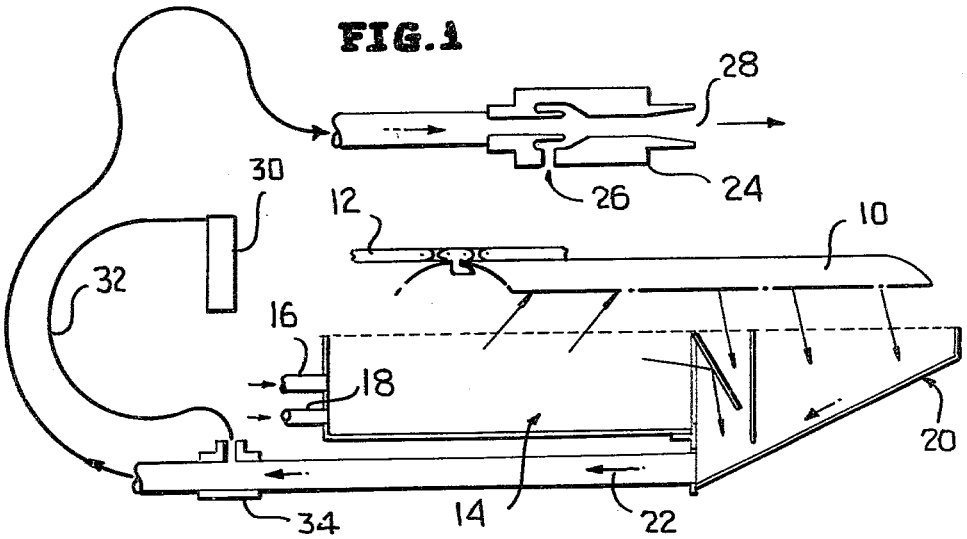
FIG. 1 is a schematic view showing the general side striping system including the applicator, the catcher and the return system.
Figure 2:
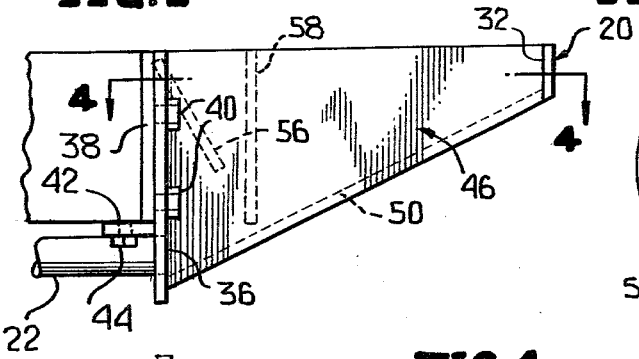
FIG. 2 is a side elevational view of the catcher and shows generally the mounting thereof on the applicator.
Figure 3:
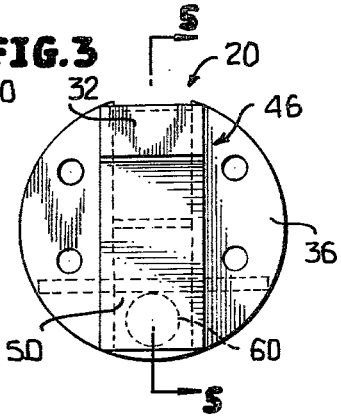
FIG. 3 is an end elevational view of the catcher viewed from the right of FIG. 2.
Figure 4:
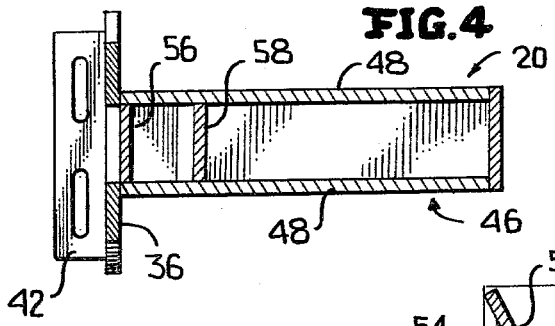
FIG. 4 is a horizontal sectional view taken generally along the line 4—4 of FIG. 2.
Figure 5:
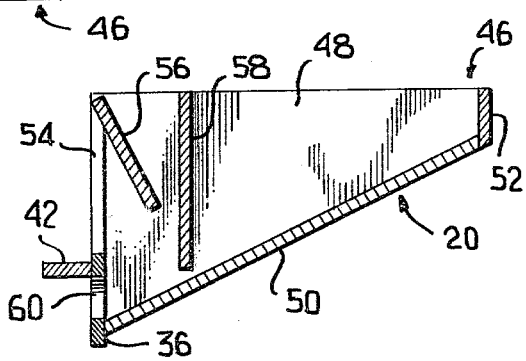
FIG. 5 is a vertical sectional view taken generally along the line 5—5 of FIG. 3.

Referring now to the drawings in detail, it will be seen that the overall system is schematically illustrated in FIG. 1. A can body 10 is moved along a predetermined path by suitable conveyor means 12. The can body is preferably formed with a welded side seam although it is feasible that the side seam could be of the soldered type. The can body 10 is formed from a body blank which is not provided with the customary tin coating. Prior to the formation of the body, the blank has a suitable coating formed thereon in the flat with the coating terminating short of the edges which are to be incorporated in or heat effected by the seam. Thus the side seam area of the resultant can body 10 is free of the required internal coating which both protects the can body against corrosion by the product and migration of metal ions into the product.

Beneficially, the side seam area of the can body 10 is provided a coating applied in the form of a powder which is electrostatically charged so as to bond to the can body. When the powder applicator is disposed immediately downstream of the seam forming mechanism, the heat generated in the side seam either by welding or by soldering will be sufficient to effect melting of the powder so as to provide for an integrated coating. The can body is formed over a horn (not shown) and the applicator is carried by such a horn. The can body 10 thus travels along a predetermined path and at a predetermined speed, with the speed being determined by the speed of the conveyor 12.

In the arrangement to which the system of this application relates, the side seam of the can body is formed at the 12 o'clock position and the coating powder is directed vertically upwardly toward the side seam while having a longitudinal component in the direction of can body movement.

The applicator, which is generally identified by the numeral 14 and which is not part of this invention, is provided with a powder supply line 16 and an air flow line 18. The powder in the powder supply line 18 is air entrained so that it will freely flow from the applicator and beyond.

As set forth above, in order to make certain that there is available sufficient powder to effect the desired side stripe formation, there is an overspray of powder. Further, in any powder application there are stray powder particles. In order to confine powder flow within the can body in the area of the side seam, the applicator will normally have powder path defining means (not shown) which are not part of this invention. This limits the powder flow to a restricted cross sectional area within the can body, which area is in alignment and contiguous to the side seam.

A catcher, which is the principal feature of this invention and is generally identified by the numeral 20, is provided for the purpose of collecting from the interior of the can body all coating powder which has not electrostatically adhered to the side seam area. The catcher 20 is preferably supported by the applicator 14.

A return tube or line 22 is connected to the catcher for returning collected powder and a suitable vacuum is maintained within the return tube 22. The required vacuum is induced into the return tube 22 by means of a vacuum flow transducer 24 which is a commercially available item. An acceptable vacuum flow transducer is manufactured by Air-Vac Engineering Company, Inc. of Milford, Connecticut. A Series TDRH model transducer has been successfully tested. The transducer 24 is provided with an air supply line 26 wherein compressed air at a pressure on the order of 80 psi is introduced into the transducer. The transducer 24 has an outlet 28 which is coupled to a recovery system which is not part of this invention and which is not specifically illustrated.

The vacuum within the return tube 22 adjacent the catcher 20 may be monitored through a simple water manometer 30 which is coupled by way of a line 32 to a fitting 34 in the return line 22 as close as is mechanically feasible to the catcher. A typical manometer pressure reading is 13 inches of water for normal operation.

The catcher 20 is most specifically illustrated in FIGS. 2–5. It will be seen that the catcher 20 includes a mounting plate 36 which is generally circular in outline and which is secured to a like plate 38 on the downstream end of the applicator 14 by means of suitable fasteners 40. A further mounting plate 42 underlies the downstream end of the applicator 14 and is secured thereto by suitable fasteners 44.

The catcher 20 includes a catcher housing 46 which extends downstream from the mounting plate 36 with the mounting plate 36 partially closing the upstream end of the catcher housing 46.

The catcher housing 46 is generally rectangular in horizontal cross section and includes a pair of transversely spaced upstanding walls 48 which are generally trapezoidal in side elevation. The lower edges of the side walls 48 are connected together by a downwardly and upstream sloping bottom wall 50. The downstream end of the catcher housing 46 is closed by an end wall 52 and as is readily apparent from FIG. 5, the catcher housing 46 has an open top.

The upper portion of the mounting plate 36 is provided with a centrally located powder passage 54 which opens into the upstream end of the catcher housing 46. The powder passage 54 is aligned with a similar opening or passage in the mounting plate 38 and also with the general powder flow passage through the applicator 14, neither of which is illustrated.

In order that powder, as well as air, passing through the powder passage 54 may be directed for return, there is mounted immediately downstream of the mounting plate 36 a downwardly sloping deflector 56. Downstream of the deflector 56 there is an upstanding baffle 58 which is spaced above the bottom wall 50.

The mounting plate 36 is provided immediately above the upper surface of the bottom wall 50 with a return passage 60 which opens into the return tube 22. Thus collected powder entering into the catcher 20 flows down against the bottom wall 50 and then out through the return passage 60.

As is schematically illustrated in FIG. 1, the stray powder particles pass directly through the applicator 14 and into the front of the catcher 20 through the powder passage 54. Other powder particles, primarily in the form of overspray, enter into the catcher housing 46 through the open top. It is to be understood that the longitudinal extent of the catcher housing 46 is such that under normal operating conditions all deflected and air entrained powder not electrostatically adhering to the can body side seam area will be received by the catcher 20 and thus available for return to the recovery area. By catching all of the overspray and stray powder particles, the existence of powder particles bonding to the can body interior in areas other than the side seam area is substantially eliminated.

Although only a preferred embodiment of the catcher and its incorporation in the powder return system has been specifically illustrated and described, it is to by understood that minor variations may be made in the catcher and the return system without departing from the spirit and scope of the invention as defined by the appended claims.

What is claimed as new is:

1. For use in an apparatus for applying a powder stripe to the interior of a tubular member, a catcher for separately receiving deflected and stray powder particles, said catcher comprising an upstanding mounting plate, a powder passage through an upper portion of said mounting plate for receiving stray powder particles, a catcher housing extending horizontally from said mounting plate in horizontal alignment with said powder passage, said catcher housing being closed with the exception of a horizontally extending open top and having a sloping bottom wall sloping downwardly towards said mounting plate, said catcher housing open top forming means for receiving deflected particles and a return passage through said mounting plate opening into said catcher housing adjacent said bottom wall.

2. A catcher according to claim 1 wherein there is a baffle sloping down into said catcher housing from an upper part of said mounting plate for deflecting stray powder particles entering into said catcher housing through said powder passage downwardly towards said sloping bottom wall.

3. A catcher according to claim 2 wherein there is an upstanding baffle in said catcher housing beyond said downwardly sloping baffle.

4. A catcher according to claim 1 wherein a return line is connected to said mounting plate in alignment with said return passage, and vacuum means are connected to said return line for applying a suction to the interior of said catcher housing.

5. A catcher according to claim 4 wherein said vacuum means includes a controllable vacuum flow transducer.

6. A catcher according to claim 4 wherein said vacuum means includes a controllable vacuum flow transducer and there are vacuum indicating means coupled to said return line adjacent said catcher.

7. A catcher according to claim 1 wherein there is a powder applicator disposed entirely upstream of said catcher, and said mounting plate is secured to said powder applicator.

8. A catcher according to claim 7 wherein said catcher forms a longitudinal continuation of said powder applicator.

9. A catcher according to claim 1 wherein said catcher housing is narrow in cross-section as compared to the width of said mounting plate.

10. A catcher according to claim 1 wherein said catcher is mounted within a path of tubular members to be striped.

* * * * *